US006371042B1

(12) United States Patent
Abernethy et al.

(10) Patent No.: US 6,371,042 B1
(45) Date of Patent: Apr. 16, 2002

(54) FOLDING KAYAK

(76) Inventors: Dwight W. Abernethy, 143 Nokomis Crescent, Saskatoon, Saskatchewan (CA), S7K 5C9; Gordon E. Espeseth, 1326-13th Street, E. Saskatoon, Saskatchewan (CA), S7H 0C6

( * ) Notice: Subject to any disclaimer, the term of this patent is extended or adjusted under 35 U.S.C. 154(b) by 0 days.

(21) Appl. No.: 09/558,502

(22) Filed: Apr. 26, 2000

(51) Int. Cl.[7] ..... B63B 7/06
(52) U.S. Cl. ..... 114/354; 114/347
(58) Field of Search ..... 114/347, 354

(56) References Cited

U.S. PATENT DOCUMENTS

| | | | | |
|---|---|---|---|---|
| 389,817 | A | | 9/1888 | King |
| 1,649,311 | A | | 11/1927 | Kaechele et al. |
| 2,415,495 | A | | 2/1947 | Humphreys |
| 3,123,841 | A | | 3/1964 | Bronner |
| 3,869,743 | A | | 3/1975 | Brown et al. |
| 4,004,307 | A | | 1/1977 | Hermann |
| 4,057,865 | A | | 11/1977 | Trautwein |
| 4,274,170 | A | | 6/1981 | Simpson |
| 4,290,157 | A | * | 9/1981 | Jensen, Jr. ..... 114/354 |
| 4,407,216 | A | | 10/1983 | Masters |
| 4,480,579 | A | | 11/1984 | Masters |
| 4,841,899 | A | | 6/1989 | Fleckles et al. |
| 5,875,731 | A | | 3/1999 | Abernethy et al. |

FOREIGN PATENT DOCUMENTS

FR 2 539 097 A1 * 7/1984

* cited by examiner

*Primary Examiner*—Sherman Basinger
(74) *Attorney, Agent, or Firm*—Townsend and Townsend and Crew LLP

(57) ABSTRACT

A collapsible boat comprising forward and aft hull sections, each of which comprising a plurality of longitudinal frame members and transverse cross members. The frame members are joined into longitudinal alignment by sliding a male end of a frame member into a complimentary female end of an adjacent frame member. The frame members are also interconnected to the cross members at a plurality of connector portions to create the forward and aft hull sections. Interlocking mechanisms are used to join together the forward and aft hull sections to define a hull framework having elongate frame members that extend longitudinally between a bow and stern and that are spaced and braced by transversely extending cross members. A variable tensioning mechanism permits variation of the elevation of the bow and stem of the framework by adjusting the overall length of the elongate frame members. The framework is insertable into a flexible water impermeable skin to create a boat with adjustable handling characteristics suitable for use in a wide variety of water conditions and environments. The water impermeable skin is provided with one or more water resistant hatch for loading and unloading of the collapsible boat, and a central cockpit opening having a removable coaming and a resealable deck slit to provide for an enlarged opening through which the forward and aft hull sections may be inserted in assembling the framework.

14 Claims, 6 Drawing Sheets

FOLDING KAYAK

FIELD OF THE INVENTION

This invention relates to a collapsible boat in which a skin or shell of waterproof material covers a collapsible internal framework of rigid members.

BACKGROUND OF THE INVENTION

Collapsing or foldable boats such as kayaks or canoes are well known and have been commercially available for many years. The following patents, for example, disclose water craft that are designed to be collapsed from a watergoing form into a relatively compact form for storage and/or transportation: U.S. Pat. No. 389,817 to King; U.S. Pat. No. 1,649,311 to Kaechele; U.S. Pat. No. 2,415,495 to Humphreys; U.S. Pat. No. 3,123,841 to Bronner; U.S. Pat. No 3,869,743 to Brown; U.S. Pat. No, 4,004,307 to Hermann; U.S. Pat. No. 4,057,865 to Trautwein; U.S. Pat. No. 4,274,170 to Simpson; U.S. Pat. No. 4,407,216 to Masters; U.S. Pat. No. 4,480,579 to Masters; U.S. Pat. No. 4,841,899 to Fleckles; and U.S. Pat. No. 5,875,731 to Abernethy et al.

SUMMARY OF THE INVENTION

In one aspect, the invention provides a collapsible boat comprising forward and aft hull sections, each of which comprising a plurality of longitudinal frame members and transverse cross members. The frame members are joined into longitudinal alignment by sliding a male end of a frame member into a complimentary female end of an adjacent frame member. The frame members are also interconnected to the cross members at a plurality of connector portions to create the forward and aft hull sections. Interlocking mechanisms are used to join together the forward and aft hull sections to define a hull framework having elongate frame members that extend longitudinally between a bow and stern and that are spaced and braced by transversely extending cross members. A variable tensioning mechanism permits variation of the elevation of the bow and stern of the framework by adjusting the overall length of the elongate frame members. In some embodiments, the present invention accordingly provides a vessel that may be adapted to handle different water conditions by allowing the user to vary the rocker while in the boat, without having to paddle to shore to make the adjustments. The framework is insertable into a flexible water impermeable skin to create a boat with adjustable handling characteristics suitable for use in a wide variety of water conditions and environments. The water impermeable skin is provided with one or more water resistant hatches for loading and unloading of the collapsible boat, and a central cockpit opening having a removable coaming and a resealable deck slit to provide for an enlarged opening through which the forward and aft hull sections may be inserted in assembling the framework.

DETAILED DESCRIPTION OF THE INVENTION

Figure 1:
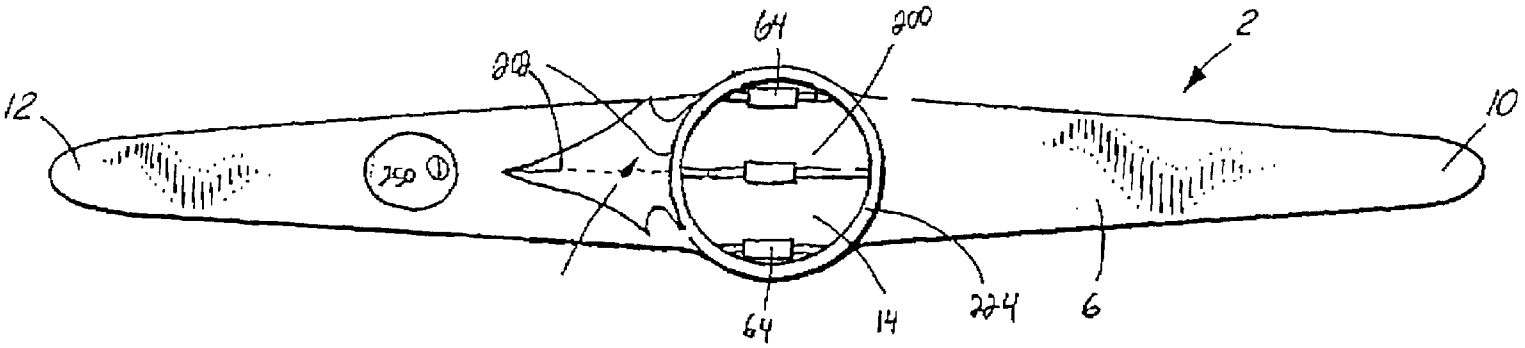
FIG. 1 is a top plan view of a folding kayak in accordance with one embodiment of the invention.
Figure 2:
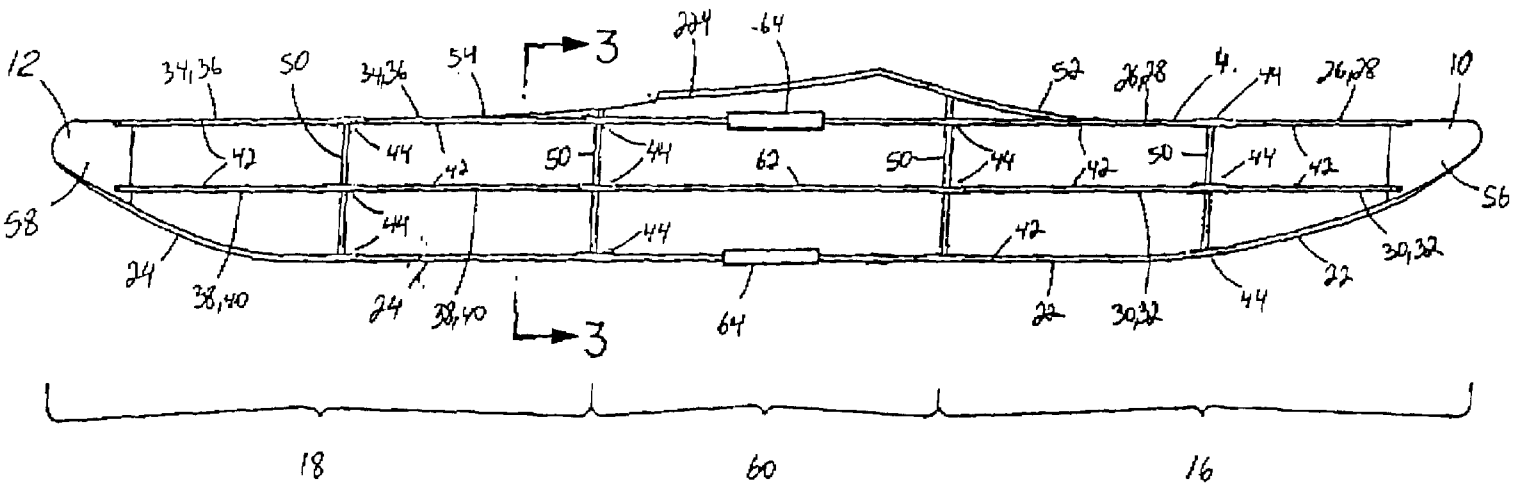
FIG. 2 is side elevational view of a folding kayak of the invention, showing the internal framework.

Referring to FIGS. 1 and 2, there is shown a kayak 2 and a kayak internal framework 4 constructed according to a preferred embodiment of the present invention. In FIG. 1, the framework 4 is covered by a flexible water impermeable layer or skin 6 that conforms closely to the shape of the framework. The kayak 2 has a bow 10 and a stem 12 and a central cockpit 14.

Internal framework 4 comprises a forward hull section 16 and an aft hull section 18, each hull section has elongate longitudinal members including forward and aft keel members 22 and 24, port and starboard forward gunwale members 26 and 28 and port and starboard forward stringer members 30 and 32. As best shown in the hull cross-section of FIG. 3, the framework also includes port and starboard aft gunwale member portions 34 and 36 and port and starboard aft stringer members 38 and 40.

The longitudinal keel, gunwale and stringer members are formed from a plurality of longitudinal frame members 42 that are connected end to end at connection 44 to form the elongate longitudinal members that define forward and aft hull sections 16 and 18, respectively, Cross members 50 extend transversely between the elongate longitudinal members at connections 44 to brace and space the longitudinal members. In the kayak configuration illustrated, forward and aft elongate deck members 52 and 54, respectively, are also provided between forward and aft port and starboard gunwale member portions 26,28 and 34,36 to support skin 6 over the top of the framework. It will be readily apparent to those skilled in the art that the framework structure of the present invention is not limited to use in a kayak. The internal framework of the present invention can be readily designed to define the hull of other small water vessels such as a canoe. However, for the purposes of illustration only, the embodiment described is a kayak.

Forward and aft hull sections 16 and 18 include a bow or stem plate 56 and 58, respectively, to which the gunwale, stringer and deck members are releasably fastened. Plates 56 and 58 are preferably rigidly attached by welding to the ends of the outermost keel member portions 22 and 24 respectively. The plates are suitably shaped to define a smoothly rounded bow and stem to the kayak beneath skin 6. Adjacent keel, gunwale, deck and stringer member portions for connection end-to-end are preferably joined by elastic cords (not shown) so that the various member portions can remain connected by the cords when the framework is collapsed into component parts to prevent losing parts. All the longitudinal members and cross-rib members are preferably aluminum alloy tubes selected for their lightweight, strength and corrosion resistance.

The forward and aft hull sections 16 and 18 are joined in the cockpit region of the kayak by an interlocking mechanism 62, or by a variable tension mechanism 64, that joins together corresponding keel, gunwale and stringer members from the forward and aft hull sections. A variable tension mechanism 64 may be provided for all elongate frame members but it will be readily apparent to those skilled in the art that the necessary adjustments may be accomplished by three tensioning mechanisms: one between forward and aft keel members 22 and 24, one between forward and aft starboard gunwale members 28 and 36, and one between forward and aft starboard gunwale members 28 and 36, and one between forward and aft port gunwale members 26 and 34. The variable tension mechanism 64 permits variation of the elevation of the bow and stem of the framework by adjusting the overall length of the gunwale and/or the keel members as will be described. Port and starboard forward and aft stringer members 30, 32 and 40 may be respectively joined together by interlocking mechanism 62. The result is an assembled framework as illustrated in FIG. 2 that defines a hull having elongate keel, gunwale and stringer members that extend longitudinally between bow 10 and stem 12 and that are spaced and braced by the transverse cross members 50.

Figures 3, 4, 5, 6:
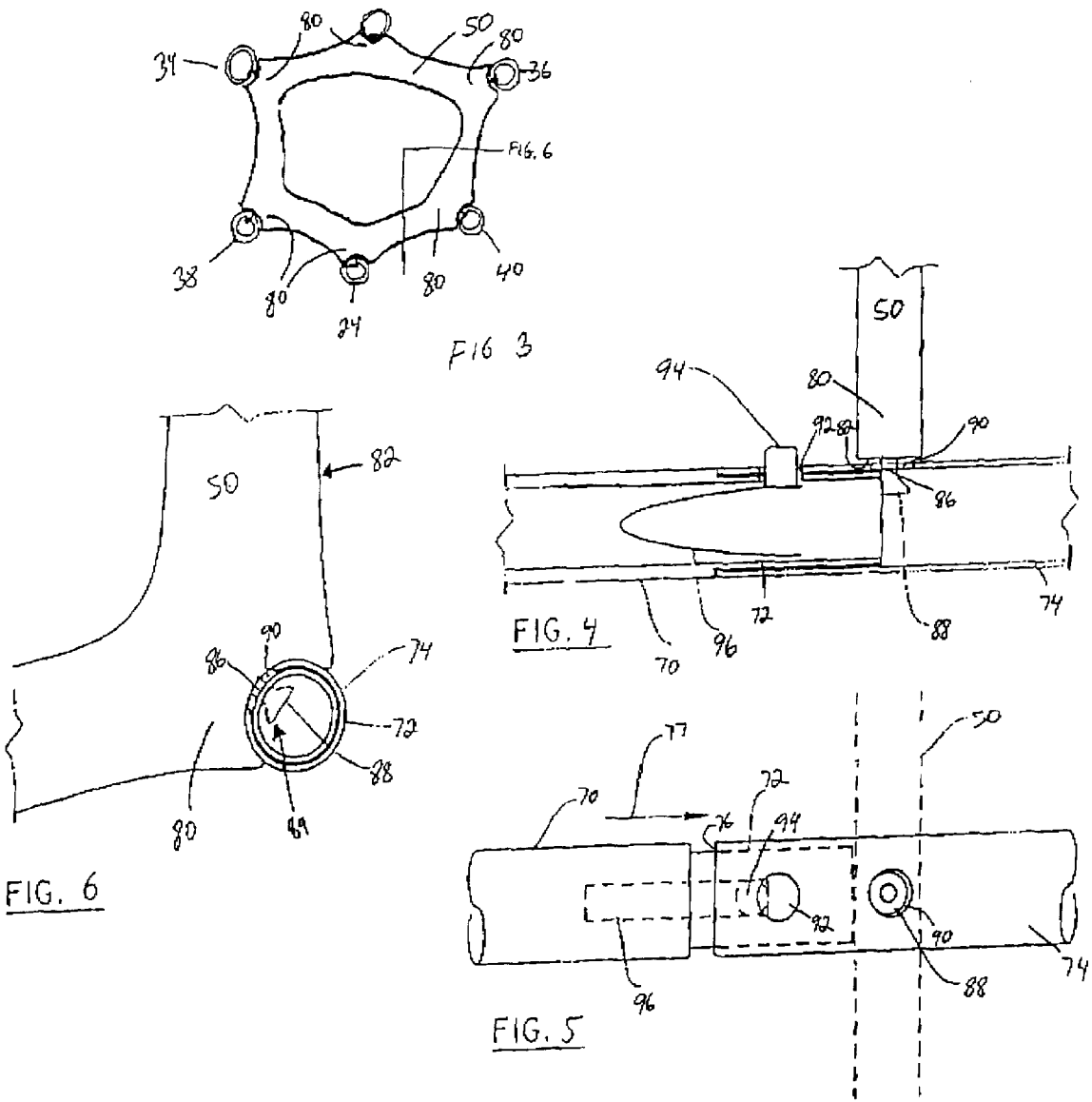
FIG. 3 is a cross-sectional view along the section indicated by arrows in FIG. 2.
FIG. 4 is a partially broken away cross-sectional side view of a connection between frame members, showing the members fully engaged.
FIG. 5 is a partially broken away cross-sectional top view of a connection between frame members, showing the members partially engaged.
FIG. 6 is a partially broken away cross-sectional front view of a connection between frame members, showing the members partially engaged.

Referring to FIG. 4, 5 and 6, there is shown a detail view of a typical connection 44 for joining various longitudinal frame members end to end and to transverse cross members 50. Each connection 44 comprises an end of a first portion 70 of a frame member having a male end 72 and an adjacent end of a second portion 74 of an adjacent frame member having a complementary opening or female end 76 to receive the male end therein. The cross members 50 have a plurality of connector portions 80 spaced around the periphery of the cross member's peripheral edge 82. The connector portions 80 of the cross member 50 comprises a projection 84 having a shaft 86 and an enlarged end 88 which may be inserted into a first opening 90 in the second portion 74 of frame members 42. Cross member 50 is secured to frame member 42 by inserting the projection 84 into a first opening 90 and then inserting male end 72 of an adjacent frame member Into the female end 76 in direction 77 so that the male end of the adjacent frame member engages the enlarged end 88 of projection 84. The male end 72 may be provided with a longitudinal slot dimension to fit around shaft 86 so as to engage enlarged end 88 more fully. In the preferred embodiment, it is necessary to lock together the male and female portions of each connection 44 to reduce the possibility of the frame members becoming unintentionally separated from each other. In FIGS. 4 and 5, a locking mechanism is illustrated comprising a second opening 92 in female end and a depressible protrusion or button 94 on the male end that is spring biased 96 to protrude outwardly from the male end. When male end 72 is inserted into female end 76, button 94 extends into second opening 92 to lock the male and female ends together on alignment of second opening 92 and button 94.

Figure 7:
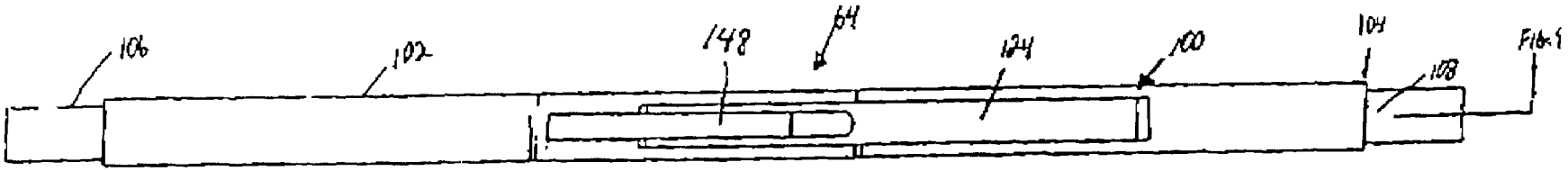
FIG. 7 is a top plan view of a tension mechanism of the invention.
Figure 8:
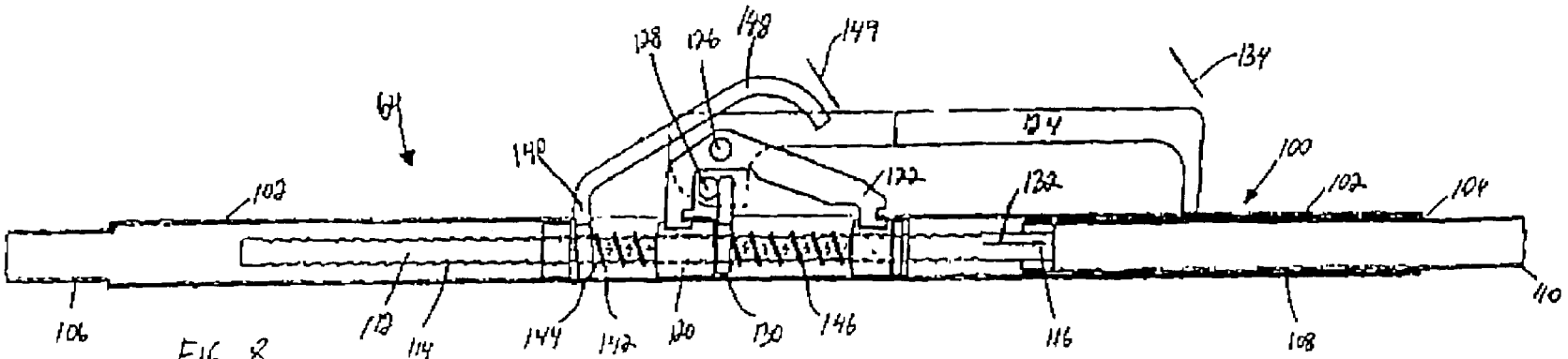
FIG. 8 is a cross-sectional view of a tension mechanism along the line shown by arrows in FIG. 7.
Figure 9:
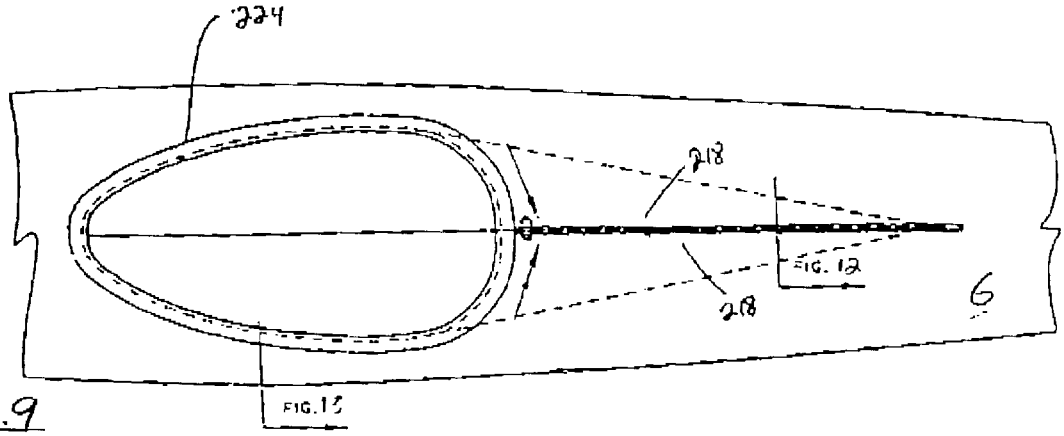
FIG. 9 is a partially broken away top plan view of a cockpit opening, showing a slit in the skin of the kayak in a closed configuration.
Figure 10:
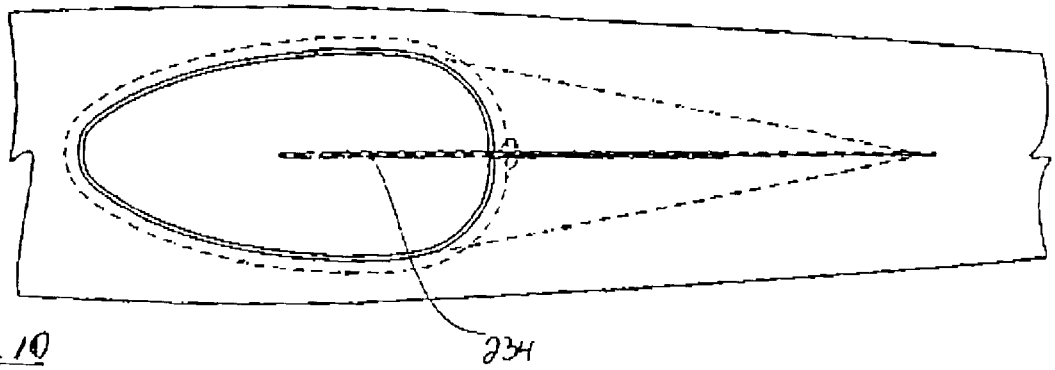
FIG. 10 is a partially broken away top plan view of a cockpit opening, showing a slit in the skin of the kayak in a partially open configuration.
Figure 11:
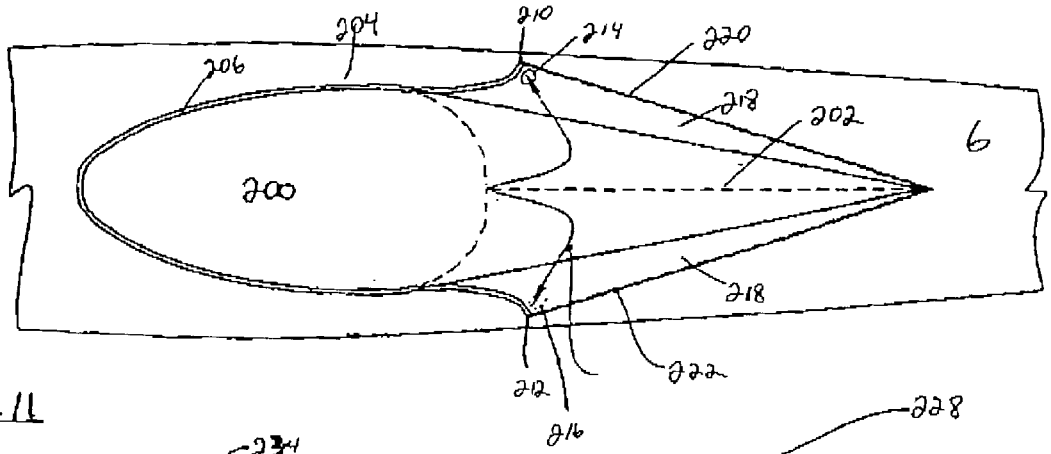
FIG. 11 is a partially broken away top plan view of a cockpit opening, showing a slit in the skin of the kayak in an open configuration.
Figure 12:
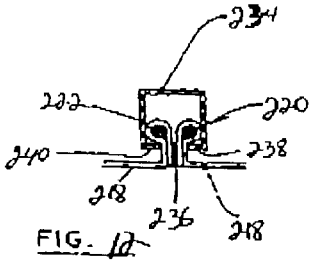
FIG. 12 is a partially broken away cross-sectional view of the sealing mechanism for sealing a slit in the skin of the kayak, along the line shown by an arrow in FIG. 9.
Figure 13:
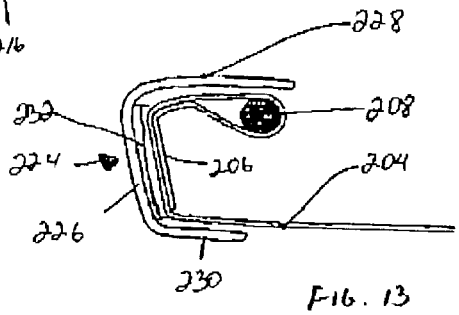
FIG. 13 is a partially broken away cross-sectional view of a coaming member and associated apparatus used to form a cockpit opening, along the line shown by an arrow in FIG. 9.

Referring to FIGS. 7 and 8, there is shown the variable tension mechanism 64 of the present invention. Tension mechanism 64 is telescoping so that it is insertable between and connectable to forward and aft longitudinal members. Tension mechanism 64 includes a telescoping member 100 comprising an outer tube 102 with a first end 104 and a second end 106 that is insertable into the female end of a frame member from the forward or aft hull sections that extends into the central cockpit region 60 of the framework. Telescoping member 100 also includes an inner tube 108 slideable within the outer tube and extending from the first end 104 of the outer tube 102, and having an end 110 being insertable into the female end of an adjacent frame member from the forward or aft hull sections that extends into the central cockpit region 60 of the framework. Such female end of frame members from forward or aft frame sections is provided with a stop, the structure of which would be apparent to a person skilled in the art, to limit the distance that ends 104 and 110 may be inserted into the female end. A rod 112, preferably formed with a ratcheted surface 114, is movably disposed within the outer tube of the telescoping member and having one end 116 connected to the inner tube 108. An actuator in the form of a guide 120 is provided about rod 112 and connected to the outer tube 102 by an arm 122. A lever 124 is connected to the arm 122 by pivot 126. Lever 124 includes a pin 128 and a dog 130 that is engageable with the ratcheted surface 114 of the rod 112 to move the rod and inner tube in the direction 132 to extend the telescopic member 100. As lever 124 is raised in direction 134 about the pivot 126, the pin 128 pushes the top portion of dog 130 in direction 132 which engages the ratcheted surface of the rod forcing the rod in direction 132. Rod 112 is free to move in direction 132 through opening 144 in locking member 140. When lever 124 is lowered in a direction opposite to direction 134, spring 142 acts on the locking member 140 causing it to pivot such that opening 144 is misaligned with rod 112 and the opening engages the ratcheted surface 114 thereby acting as a lock on the rod preventing the rod from moving counter to direction 132. As the lever 124 is lowered, spring 146 acts on dog 130 which slips back on the rod to its starting position. To disengage locking member 140 to allow the telescoping member 100 to shorten, locking member 140 has a handle 148 by which the locking member is pivoted to align hole 144 with rod 112 such that member 140 is disengaged from the ratcheted surface. When the handle 148 is moved in direction 149, rod 112 is thereby allowed to move in a direction opposite of direction 132.

When assembling the collapsible kayak of the present invention, the forward and aft hull sections 16 and 18 are constructed initially and inserted into the ends of skin 6 as illustrated in FIG. 1. Referring to FIG. 9 through 13, skin 6 has a central cockpit opening 200 and a deck slit 202 extending from the cockpit opening 200 to allow for enlargement of the cockpit opening to permit the hull sections to be inserted into the skin. The skin 204 adjacent the cockpit opening 200 has a collar 206 attached thereto with an enlarged edge 208. The comers 210 and 212 located where the deck slit 202 converges with the cockpit opening have fasteners 214 and 216 that are connectable with one another. As well, the skin 218 adjacent the deck slit has sealing portions 220 and 222 with enlarged edges. Once the forward and aft hull sections are inserted into skin 6, the corresponding forward and aft keel members, gunwale members and stringer members of each hull section are connected by interlocking mechanism 62 or variable tension mechanism 64, as the case may be. The variable tension mechanism 64 is maintained in place by the inwardly acting longitudinal forces resulting from the tension of the skin 6 acting on the framework 4. A rigid annular coaming member 224 is then inserted into the cockpit opening 200. The coaming member 224 has a central body 226 dimensioned for a close fit within the cockpit opening, and top and bottom portions 228 and 230 radiating outwardly from the central body such that a cross section of the coaming member generally defines a "U"-shape and forms a channel 232 around the periphery of the coaming member. The collar 206 is drawn around the channel 232 of the coaming member 224 and fasteners 214 and 216 are drawn towards each other and connected. The sealing portions 220 and 222 are drawn together and a sealing mechanism, in the preferred embodiment, an elongated member 234 having a longitudinal channel 236 and inwardly extending flange portions 238 and 240 along the length of the channel, is slid over the sealing portions to engage the enlarged edges and maintain them in contact with each other to form a waterproof seal.

Figure 14:
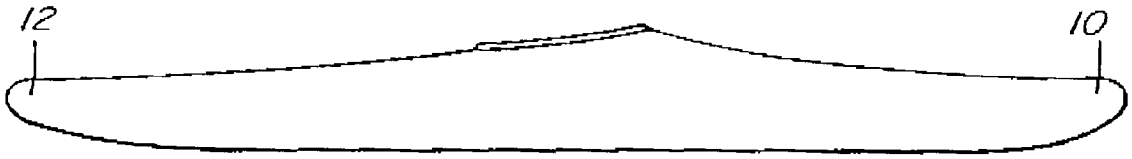
FIG. 14 is a side elevational view of a kayak, showing no rocker or keel curvature.
Figure 15:
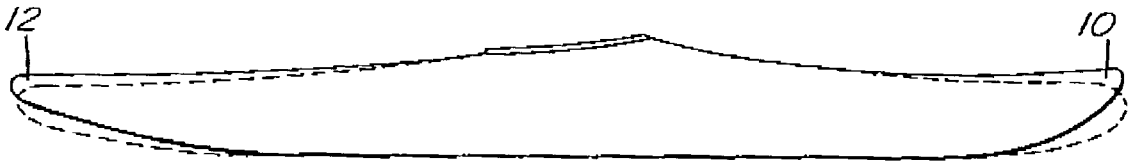
FIG. 15 is a side elevational view of a kayak, showing rocker and keel curvature.
Figure 16:
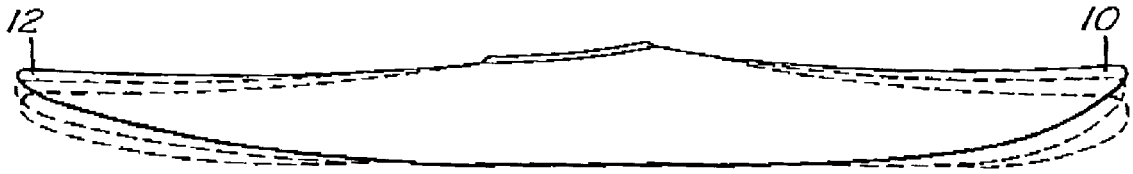
FIG. 16 is a side elevational view of a kayak, showing rocker and keel curvature.
Figure 17:
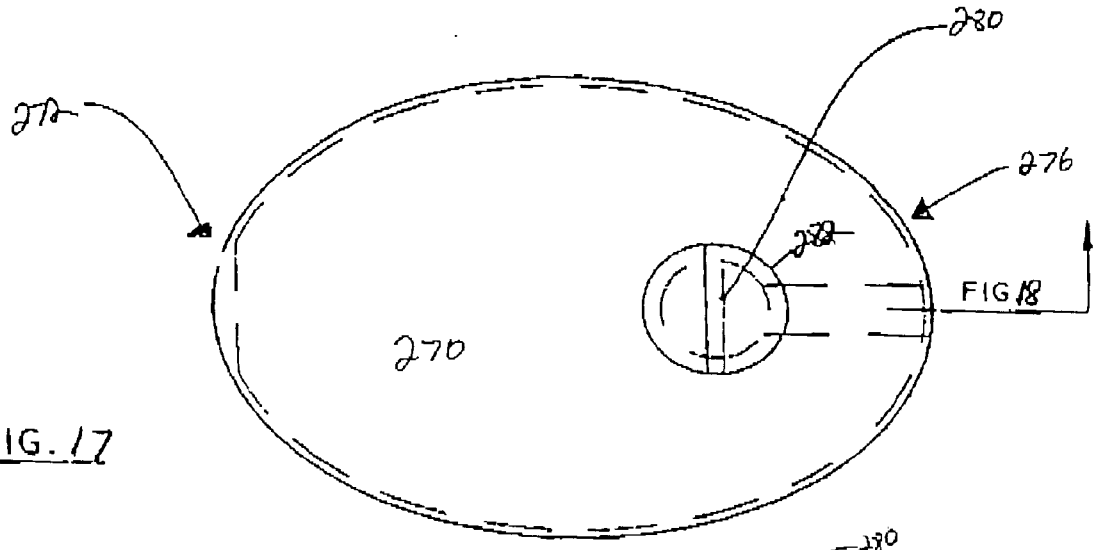
FIG. 17 is a top plan view of a lid for a hatch.
Figure 18:
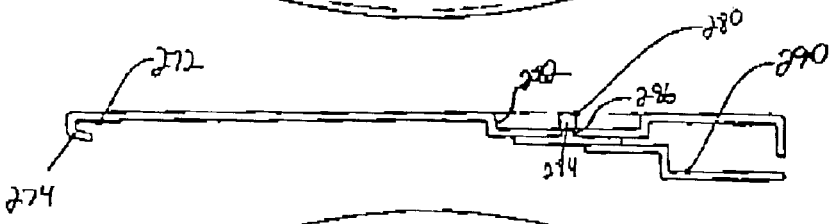
FIG. 18 is a cross-sectional view showing a lid for a hatch, along the section line shown by an arrow in FIG. 17.
Figure 19:
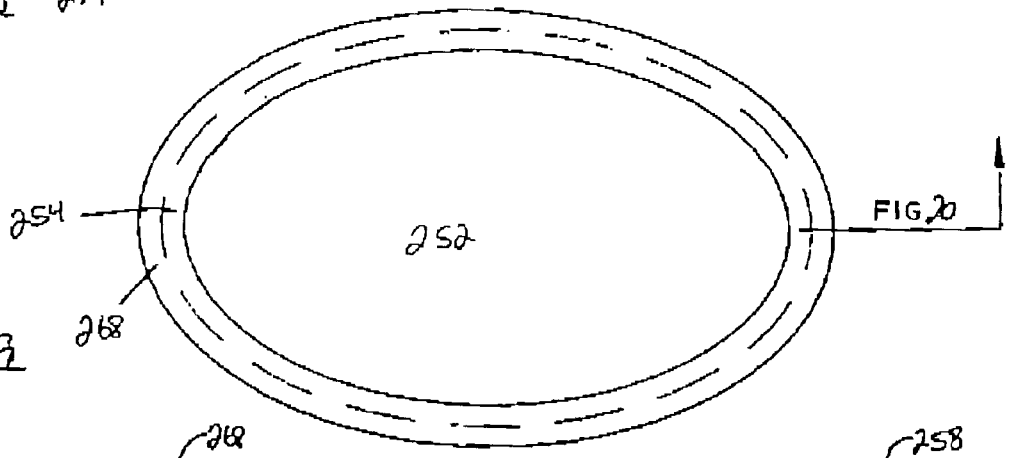
FIG. 19 is a top plan view of a hatch opening, showing top and bottom hatch portions defining the hatch opening.
Figure 20:
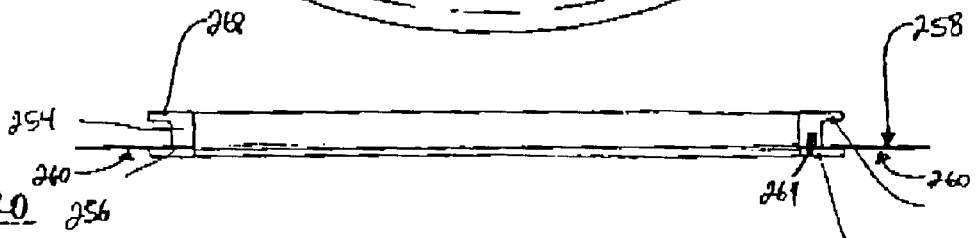
FIG. 20 is a cross-sectional view showing the top and bottom hatch portions defining the hatch opening, along the section line shown by an arrow in FIG. 19.
Figure 21:
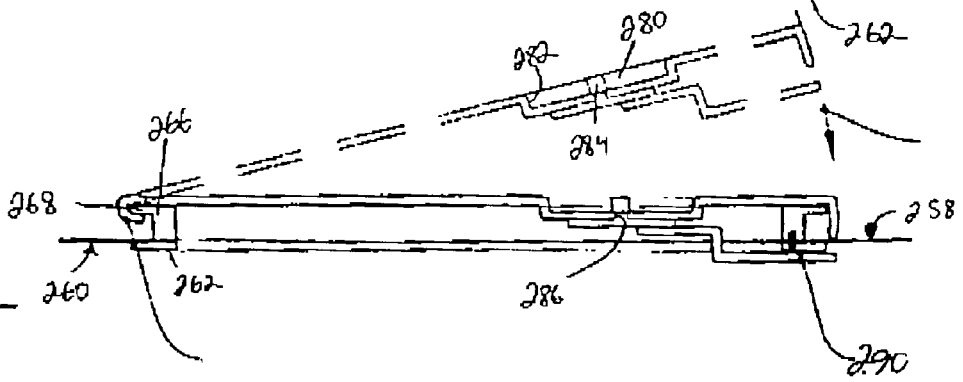
FIG. 21 is a cross-sectional side view showing the hatch lid and hatch portions assembled on the hatch opening, showing the hatch lid in phantom lines in an open configuration.

The variable tension mechanisms operate to change the length of the keel, gunwale or stringer members. As the gunwale length shortens, the bow 10 and stern 12 of the boat rise thus increasing the rocker or curvature of the keel. The shorter the gunwale length, the higher the bow 10 and stern 12 and the greater the rocker. FIG. 14 shows a kayak with no rocker or keel curvature which is appropriate for flat water conditions to assist in keeping the kayak travelling in a straight line. FIGS. 15 and 16 show different rocker positions with an increasingly curved keel. In general, the greater the curvature or rocker of the keel, the greater the turning ability of the kayak hull. Furthermore, by lengthening or shortening one gunwale member in relation to the other gunwale member the lateral curvature of the kayak may be adjusted to give the kayak a tendency to yaw to one side. The ability to adjust the yaw of a kayak is advantageous in compensating for the tendency of the kayak to drift laterally in a cross-wind or cross-current.

Also provided in the present invention is one or more hatches 250 in the skin to allow for more convenient loading of gear into the hull of the kayak. Referring to FIGS. 17 through 21, the deck portion of the skin 6 has a hatch opening 252. Around the hatch opening 252 is an annular top hatch portion 254 having a material contact surface 256 dimensioned for conformable contact with the outer surface 258 of the skin adjacent the hatch opening. On the inner surface 260 of the skin 6 is an annular bottom hatch portion 262 dimensioned for a conformable fit with the contact surface 256 of the top hatch portion 254 and the inner surface 260 of the skin adjacent to the hatch opening 252. The top and bottom hatch portions 254 and 262 with the skin 6 sandwiched therebetween are connected to one another by a plurality of connectors 264 extending between the top hatch portion and the bottom hatch portion. The top batch portion 254 also has a lid end 266 opposite the contact surface 256 that has a flange 268 extending radially therefrom such that a cross section of the top hatch portion tends to resemble an inverted "L". The hatch 250 also includes a lid 270 dimensioned for a conformable and generally waterproof fit over the top hatch portion 254 and having an engaging end 272 with a flange 274 extending downwardly and inwardly which engages the flange 268 on the top hatch portion 254. The lid 270 also has a locking end 276 opposite the engaging end and having a locking mechanism comprising an actuator such as a dial 280 seated in a depression 282 in the lid and a portion 284 of the dial 280 extending through a hole 286 in the lid to engage a latch portion 290 that is movably mounted on the inner surface of the lid. The actuator engages the latch causing it to move between a first position in which the latch portion does not impede the removal of the lid from the hatch, and a second position in which the latch portion engages the hatch so as to impede the removal of the lid from the hatch. Also, in the preferred embodiment, the latch portion 290 has a leading edge that tapers to a thicker trailing edge so that the leading edge engages the hatch prior to the trailing edge as the latch portion is moved from first position to second position thereby gradually increasing the locking tension on the lid.

Although the present invention has been described in some detail by way of example for purposes of clarity and understanding, it will be apparent that certain changes and modifications may be practiced within the scope of the appended claims. Many adaptations and modifications may be made within the scope of the invention in accordance with the common general knowledge of those skilled in this art. Such modifications include the substitution of known equivalents for any aspect of the invention in order to achieve the same result in substantially the same way. Numeric ranges are inclusive of the numbers defining the range. In the claims, the word "comprising" is used as an open-ended term, substantially equivalent to the phrase "including, but not limited to".

What is claimed is:

1. A collapsible boat comprising:

forward and aft hull sections, each hull section comprising:

a plurality of longitudinal frame members, each frame member having a male end and a female end adapted to receive the male end of an adjacent frame member for releasably connecting therewith, the female end further having a connector portion, and a plurality of generally planar rigid transverse cross members having a peripheral edge with a plurality of connector portions thereon for cooperatively interconnecting with the connector portion of the female end of the frame member thereby when the frame members are connected to the connector portions on the cross members they define a rigid hull section of a framework, a flexible water impermeable skin for covering the framework, the skin having a central cockpit opening and a shape to receive forward and aft frame sections of the framework through the cockpit opening for subsequently joining and locking of the frame sections, and interlocking mechanisms having end portions which are releasably connectable to the forward and aft frame sections thereby permitting the forward and aft frame sections to be joined in longitudinal alignment to form the framework.

2. The collapsible boat as claimed in claim 1 in which:

the connector portion on the cross members comprises a projection from the peripheral edge of the cross member having a shaft and an enlarged end, and the connector portion on the female end of the frame members has a shape to cooperatively receive the enlarged end for releasable interlocking engagement with the enlarged end thereby releasably interconnecting the frame member to the cross member.

3. The collapsible boat as claimed in claim 2 in which:

the connector portion on the female end of the frame members comprises a first opening in the female end to receive the enlarged end of the projections and the male end of an adjacent frame member engages the enlarged end of the connector portion of the cross member when the enlarged end is inserted into the first opening and the male end is inserted into the female end.

4. The collapsible boat as claimed in claim 3 further comprising a locking mechanism on the frame members to lock adjacent frame members together once the male end of one frame member is inserted into the female end of an adjacent frame member thereby reducing the possibility of the frame members becoming unintentionally separated.

5. The collapsible boat as claimed in claim 4 in which the locking mechanism comprises:

an opening in the male end, a second opening in the female end of an adjacent frame member that aligns with the opening in the male end when the male end is inserted into the female end, and a releasable projection protruding through the opening in the male end and the second opening in the female end thereby interlocking the frame members to reduce the possibility of them becoming unintentionally separated.

6. The collapsible boat as claimed in claim 5 in which the projection is a depressible protrusion on the male end biased to protrude outwardly from the male end such that the protrusion extends into the second opening to lock the male and female ends together on alignment of the second opening and the protrusion.

7. The collapsible boat as claimed in claim 4 in which at least one of the interlocking mechanisms comprises a variable tension mechanism to permit variable and incremental adjustment of the length of the framework.

8. The collapsible boat as claim 7 in which the variable tension mechanism comprises:

a telescoping member comprising an outer frame having a first end and a second end adapted to engage an exposed end of an adjacent frame member for releasably connecting therewith, and further having a longitudinal opening along a section of the outer frame, a rod movably mounted within the outer frame and having an end protruding from the open end of the outer frame which is adapted to engage an exposed end of an adjacent frame member for releasably connecting therewith, an actuator in connection with the outer frame and being engageable with the rod through the longitudinal opening in the outer frame so that when the user exerts a force upon the actuator, the actuator acts on the rod causing it to move longitudinally thereby resulting in the telescoping member becoming elongated, the actuator further being releasable from engagement with the rod when the user releases the force so that the actuator may be returned to its original position, and a locking member in connection with the outer frame and having an engaging portion being in releasable engagement with the rod through the longitudinal opening in the outer frame, the engaging portion permitting movement of the rod in the direction of travel in which the actuator acts upon the rod, but restricting travel in the opposite directions.

9. The collapsible boat as claimed in claim 8 in which the water impermeable skin further includes:

an inner surface and an outer surface, a hatch opening, and a hatch comprising, an annular top hatch portion having a skin contact surface dimensioned for conformable contact with the outer surface of the skin adjacent the hatch opening, an annular bottom hatch portion dimensioned for a conformable fit with the contact surface of the top hatch portion and the inner surface of the skin adjacent to the hatch opening, a plurality of connectors extending between the top hatch portion and the bottom hatch portion to connect the top hatch portion to the bottom hatch portion thereby sandwiching the skin adjacent the hatch opening therebetween, a lid dimensioned for a conformable and generally waterproof fit over the top hatch portion a securing mechanism to engage the lid upon the top hatch portion.

10. The collapsible boat as claimed in claim 9 in which the annular top hatch portion has a lid end opposite the contact surface and has a flange extending radially from the lid end, the lid has an engaging end with a flange extending downwardly and inwardly for engaging the flange of the lid end of the top hatch portion, and a locking end opposite the engaging end and having a locking mechanism for engaging the hatch.

11. The collapsible boat as claimed in claimed in claim 10 wherein the lid defines an inner surface and an outer surface, and the locking mechanism of the lid further comprises:

an opening in the lid near the locking end of the lid, a latch portion movably mounted on the inner surface of the lid, the latch portion being movable between a first position in which the latch portion does not impede the removal of the lid from the hatch, and a second position in which the latch portion engages the hatch so as to impede the removal of the lid from the hatch, and an actuator movably mounted on the outer surface of the lid and extending through the opening in the lid for engaging the latch portion and causing the latch portion to move between the first and the second position.

12. The collapsible boat as claimed in claim 11 in which:

the actuator on the locking portion of the hatch comprises a dial, and the lid has a depression adjacent to the opening to accommodate the dial so that the dial is generally flush with the outer surface of the lid.

13. The collapsible boat as claimed in claim 12 in which the flexible water impermeable skin further includes:

a deck slit extending from the cockpit opening, sealing portions on the edges of both sides of the skin adjacent the deck slit, a sealing mechanism for engaging the sealing portions to join the edges of the skin to one another thereby closing the deck slit, a generally rigid annular coaming member having a central body dimensioned for a close fit within the cockpit opening, and top and bottom portions radiating outwardly from the central body such that a cross section of the annular member tends to generally define a general "U"-shape forming a channel around the periphery of the central body, and skin adjacent the cockpit opening having a collar with an enlarged edge for conformable fit within the channel when the collar is drawn around the central body of the coaming member by closing the deck slit as described above, thereby providing a generally waterproof seal between the collar and the coaming member.

14. The collapsible boat as claimed in claim 13 in which:

the sealing portions comprise an enlarged edge of the skin adjacent the deck slit, and the sealing mechanism comprises an elongated member having a longitudinal channel, to accommodate the sliding of the elongated member over the enlarged edges when the edges are brought into proximity with each other, and further having flange portions extending inwardly along the length of the channel to engage the enlarged edges thereby limiting the removal of the elongated member to slideable movement in the direction of the deck slit.

* * * * *